US006239692B1

(12) United States Patent
Maguire

(10) Patent No.: US 6,239,692 B1
(45) Date of Patent: May 29, 2001

(54) SOUNDER

(75) Inventor: John Maguire, Manchester (GB)

(73) Assignee: Coradon Friedland Limited, Stockport (GB)

( * ) Notice: Subject to any disclaimer, the term of this patent is extended or adjusted under 35 U.S.C. 154(b) by 0 days.

(21) Appl. No.: 08/892,825

(22) Filed: Jul. 15, 1997

(30) Foreign Application Priority Data

Jul. 17, 1996 (GB) ..... 9614977

(51) Int. Cl.[7] ..... G08B 3/00

(52) U.S. Cl. ..... 340/392.1; 340/392.2; 340/392.3; 340/398.1; 340/398.2; 116/155; 116/169

(58) Field of Search ..... 340/392.1, 392.2, 340/393.3, 393.4, 401.1, 398.1, 398.2, 392.4, 392.5; 116/155, 164, 167, 169

(56) References Cited

U.S. PATENT DOCUMENTS 2,820,913 * 1/1958 Christy ..... 340/392.5
3,246,241 * 4/1966 Doggart ..... 340/396.1
3,284,797 * 11/1966 Roswell ..... 340/392.5
4,335,418 * 6/1982 Clement ..... 340/392.1
4,864,275 * 9/1989 Buyak ..... 340/392.1
5,561,413 10/1996 Ashibe et al. ..... 340/393.1
5,659,286 * 8/1997 Lin ..... 340/392.1

FOREIGN PATENT DOCUMENTS 2 224 156 4/1990 (GB) .

* cited by examiner

*Primary Examiner*—Jeffery A. Hofsass
*Assistant Examiner*—Ashok Mannava
(74) *Attorney, Agent, or Firm*—Oldham & Oldham Co., L.P.A.

(57) ABSTRACT

A multi-tone sounder system including the sounder and a method of controlling the sounder in which at least a pair of chime bars (3, 5), bells or gongs are spaced apart and arranged to be struck by a solenoid operated striker (26) positioned between the chime bars; the solenoid (24) is powered by a controller (FIG. 2) in one of several ways so that in one way by sudden application of power to the solenoid the striker strikes one bar but then the power is reduced gradually preventing the striker by means of a spring (28) hitting the other bar; in a second way by gradual application of power to the solenoid and sudden reduction the other bar only is struck; in a third way by sudden application and a sudden reduction of power to the solenoid both bars may be struck; by using a predetermined combination of strikes a particular push button in a house can easily be identified.

32 Claims, 3 Drawing Sheets

SOUNDER

Figure 1:
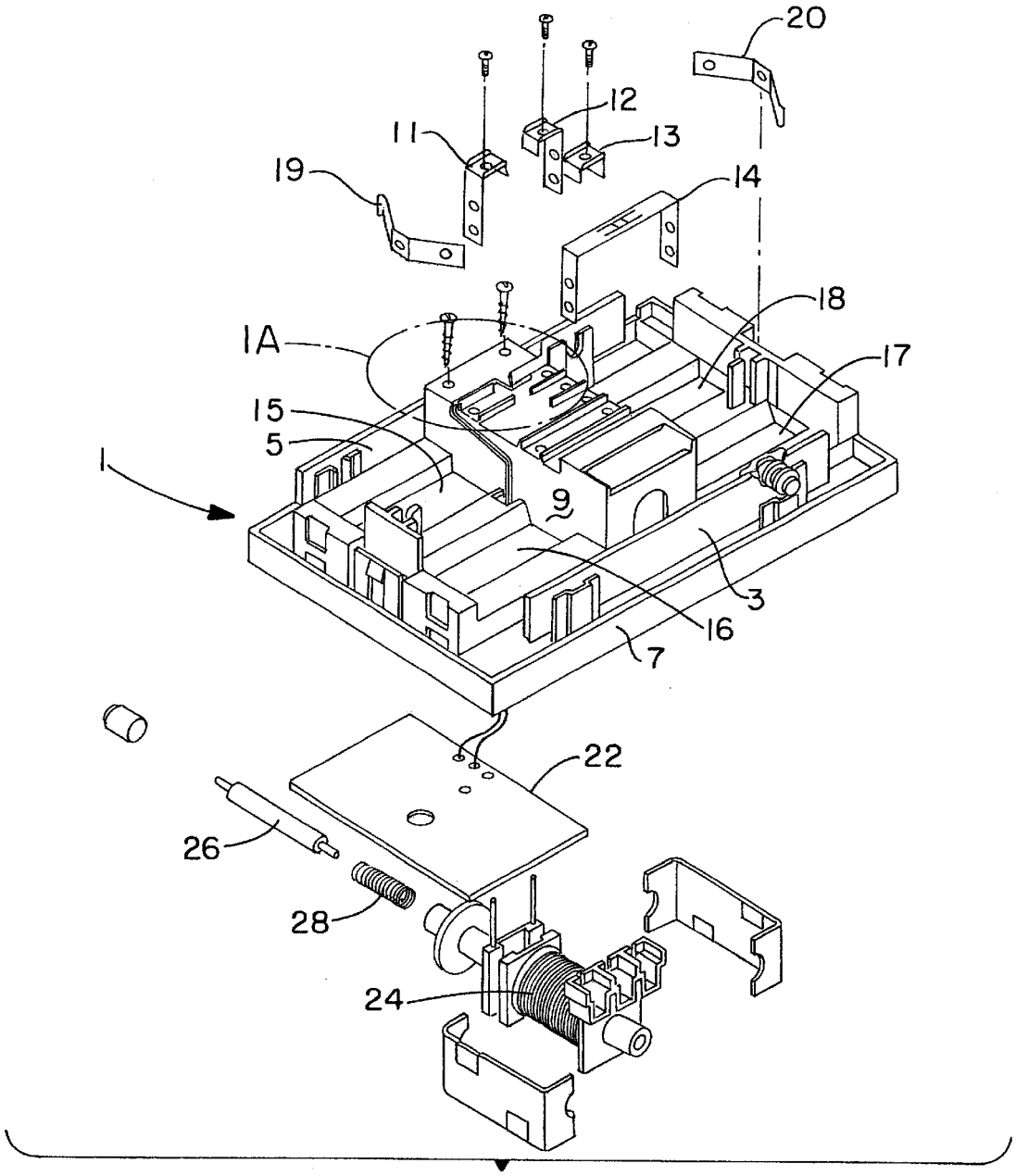
Figure 1A:
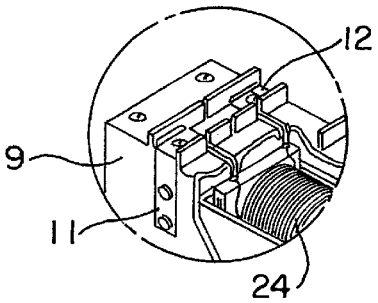

The present invention relates to electrically operated striking sounders particularly multi-tone sounders such as door chimes.

Conventional door chimes known colloquially as "ding-dong-bells" comprise a pair of chime bars, not bells, tuned to different tones and a solenoid actuated striker which when powered by a bell push causes the striker bar to hit the "ding" bar and to fall back under the action of a spring to hit the "dong" bar. The bars can be reversed to cause a "dong-ding" chime. Striking the bars is achieved by striker bar overshoot. The equilibrium positions of the striker bar or solenoid armature at both full current and zero current are such that the armature does not remain in touch with the chime bars so as to ensure free vibration of the bars. It will thus be appreciated that the chime options are limited to "ding-dong" or "dong-ding". That is only two different chimes.

It is an object of the present invention to provide cost effectively an arrangement whereby the chime can be made to sound additional chiming combinations.

A multi-tone sounder according to the present invention comprises at least two different toned chime means, an electrical solenoid coil, an armature movable by the solenoid coil to strike each chime means, resilient means arranged to act on the armature so as to urge the armature at least to an equilibrium position between striking the chime means, and current control means adapted to power the solenoid coil sufficiently to cause the armature to strike one chime means and not the other in one application of power to the solenoid coil.

In such an arrangement the sounder current control means can be arranged to power one chime means of one tone repeatedly so as to produce say a "ding-ding-ding-ding" or "dong-dong-dong-dong" noise depending on the bell push actuated.

In one embodiment this is achieved by powering the solenoid rapidly and maintaining the solenoid voltage at a steady high level for a short period of 40 to 60 ms and preferably about 50 ms then allowing the power to decrease steadily for four to six and a half times and preferably about five times the times the high level short period. The decrease time is suitably about 240 to 270 ms.

Preferably the central means is also arranged to power the solenoid sufficiently to cause the armature to strike both chime means in one application of power to the solenoid. This enables the sounder armature to produce a distinctive "ding-ding-ding-dong" chime. This is a much more distinctive aural signal than a simple "ding-dong" which can easily be confused with a "dong-ding". By suitable tuning of the chiming means this can be tuned to the opening notes of Beethoven's 5th Symphony.

This is preferably achieved by powering the solenoid rapidly maintaining the solenoid voltage at a steady high level long period of 240 to 290 ms and preferably about 265 ms. That is four to seven times the short period and preferably between five and five and a half times the short period.

In one of the embodiments of the invention the internal between adjacent "dings" and a final "dong" are controlled to be substantially equal and preferably the interval is between 200 and 400 ms and normally about 300 ms.

Figure 2:
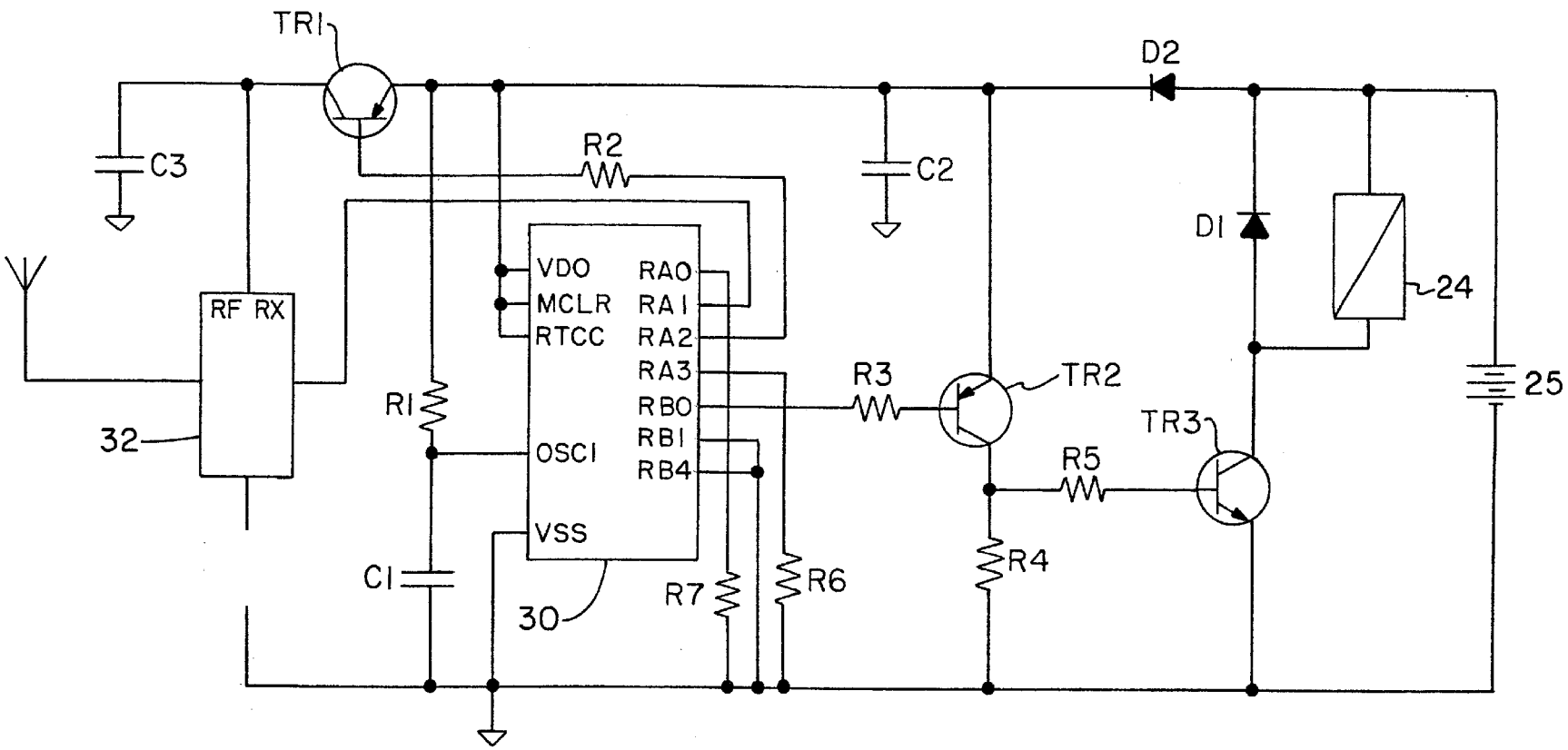
Figures 3, 4:
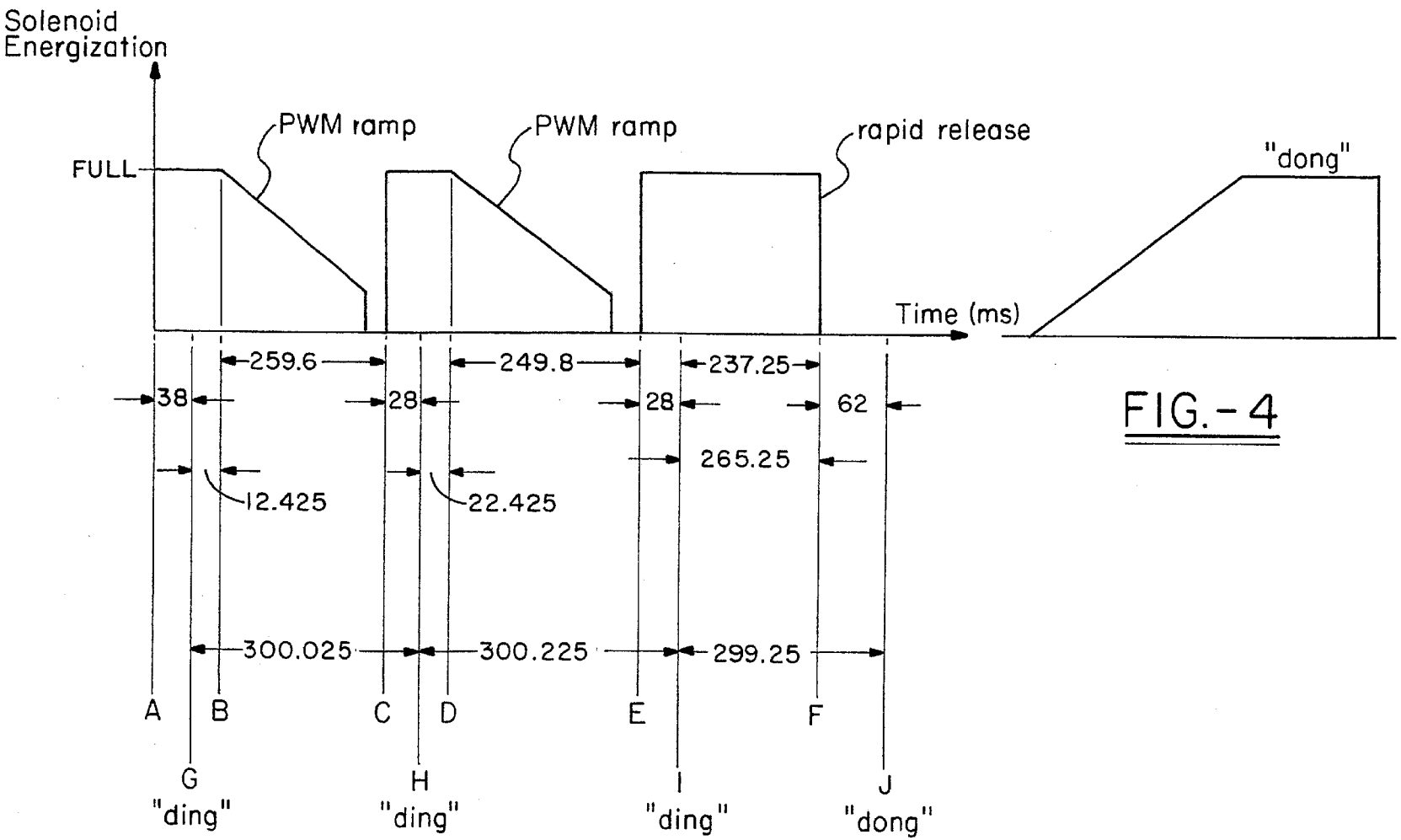

An embodiment of the invention will now be described with reference to the accompanying drawings in which:

FIG. 1 is an exploded perspective view of a multi-tone sounder according to the invention, FIG. 2 is a circuit diagram for the sounder of FIG. 1, FIG. 3 is a solenoid energisation waveform for a ding-ding-ding-dong sounding of the sounder of FIGS. 1 and 2, and FIG. 4 is a solenoid energisation waveform for a dong only sounding of the sounder of FIGS. 1 and 2.

FIG. 1 shows a two tone remote controlled sounder generally at 1 with ding and dong chime bars 3 and 5 respectively mounted on base 7. Centrally disposed on the base between chime bars 3 and 5 is a housing 9 on which are battery contact terminals 11, 12, 13 and 14 which make contact with batteries 25 (not shown in FIG. 1 but in FIG. 2) in battery compartments 15, 16, 17 and 18. Further contacts 19 and 20 are provided at other ends of the compartments. The batteries connect with the electronic circuitry shown in FIG. 2 mounted on printed circuit board 22 and solenoid coil 24.

Within solenoid coil 24 is an armature 26 acting as a striker and a coil spring 28 arranged to urge the armature or striker 26 towards the dong bar 5. The armature 26 is so dimensioned and located relative the ding and dong bars that the equilibrium position at full current powering the solenoid coil 24 does not quite touch the ding bar 3. At zero current on the coil 24 the armature 26 does not quite touch the dong bar 5. Striking only occurs on overshoot. This ensures the bars can freely vibrate.

In a known ding dong sounder a voltage is immediately applied to a solenoid coil. This causes the current to build up rapidly driving a solenoid armature to hit a ding bar. As soon as this voltage is released, the current dies relatively rapidly away and a spring pulls back the armature which then hits a dong bar.

In the present embodiment p.w.m. techniques are used to control the current build up and decay in the solenoid coil 24. Thus as shown in FIG. 3 by first supplying full drive current to the coil 24 for 50.425 ms, but this can be in a range of 40 to 60 ms, then reducing the current gradually over 240 to 270 ms, this causes the ding bar to be struck but there is insufficient momentum in the striker return to cause the dong bar to be struck. By suitable programming of the microprocessor 30 the solenoid coil can be repowered in the same way to cause another ding but not a dong ending finally with a normal ding-dong. By suitably timing the p.w.m. ramp from high to zero, the strike points indicated at G H I and J can be evenly spaced at about 300 ms (although in practice 300.025, 300.225 and 299.25 ms).

As shown in FIG. 4 by initially ramping up the current through the solenoid coil 24, the armature 26 can be taken forward slowly towards the ding bar but because of its reduced momentum it will not hit the ding bar 3. When the current is suddenly removed, the spring 28 takes over the armature control so that it hits the dong bar 5.

Clearly ding and dong bars can be replaced by other sounding means such as bells, gongs, etc.

The control arrangements for the sounder shown are able to provide any combination of two tones including one tone and any repetition. Thus FIG. 3 shows a Beethoven inspired ding ding ding dong chime, whilst FIG. 4 shows a simple dong chime. Any combination like dong ding or ding dong or ding dong dong ding can be set up and two chime bars can sound differently at least eight door bell pushes acting on a single sounder.

The circuit shown in FIG. 2 Is for a remote controlled RF signal operated sounder with RF receiver 32. However, wire operated sounder circuits can be provided instead to signal chip 30.

It will be appreciated that a particular advantage of being able to control the dings and dongs in predetermined sequences is that it enables someone in a building to readily identify which bell is being operated. The invention can also be extended to be used to play a particular tune covering, for instance, 1½ octaves whereby the number of solenoids used to play the tune need only be a half of those normally required in an electrically operated striking system because each striker can selectively hit two notes. In theory, the invention could be used with a single striker suspended on a resilient member between four or more chime tubes.

Whilst the foregoing is directed to the preferred embodiment, the scope thereof is determined by the claims which follow.

What is claimed is:

1. A multi-tone sounder comprising in combination:

a frame to which are mounted in spaced apart relationship at least a first and a second chime means, each chime means being tuned to a different tone from the other;

striker means including an armature mounted to said frame for movement between said first and said second chime means so as to strike said first chime means in a first direction of movement and said second chime means in a second direction of movement;

a solenoid coil mounted to said frame and associated with said armature of said striker means and arranged to act thereon to cause said movement in at least one said direction of movement;

resilient means arranged to act on said striker means to urge said striker means at least to an equilibrium position between said first and said second chime means and out of contact therewith; and current control means adapted to power said solenoid coil to a high level for a short period sufficient to cause said striker means to strike one of said first and said second chime means and to control the reduction of power from the high level to zero extending over a period of four to seven times the short period, whereby by application of power to said solenoid coil, said striker means is caused to strike one of said first and said second chime means and by an optional gradual reduction of power said striker means returns toward said equilibrium position under influence of said resilient means with insufficient momentum to strike the other of said first and said second chime means.

2. The multi-tone sounder as claimed in claim 1, wherein at steady full power and at zero power said first and said second chime means are out of contact with said striker means.

3. The multi-tone sounder as claimed in claim 1, wherein said control means to the final supply of power in a repetition is reduced suddenly thereby enabling the other of said first and said second chime means to be struck.

4. The multi-tone sounder as claimed in claim 1, further including a sounder operating means remote from said multi-tone sounder arranged to pass a signal to said current control means.

5. The multi-tone sounder as claimed in claim 3, further including a plurality of sounder operating means remote from said multi-tone sounder, each said sounder operating means instructing said current control means to operate said striker means in a predetermined sequence of strikes on said first and said second chime means.

6. The multi-tone sounder as claimed in claim 1, wherein power is suddenly applied to said solenoid coil, power is maintained for a short period and power is then gradually reduced to zero.

7. The multi-tone sounder as claimed in claim 1, wherein power is gradually increased to said solenoid coil, power is maintained for a short period and power is then suddenly reduced to zero.

8. The multi-tone sounder as claimed in claim 1, wherein power is applied to said solenoid coil multiple times in one or tore of multiple ways from a selection of ways including (a) suddenly applying power to said solenoid coil and gradually reducing the power to said solenoid coil, (b) suddenly applying power to said solenoid coil and suddenly reducing the power to zero, and (c) gradually increasing the power and suddenly reducing the power to zero.

9. A multi-tone sounder comprising in combination:

a frame to which are mounted in spaced apart relationship at least a first and a second chime means, each chime means being tuned to a different tone from the other;

striker means including an armature mounted to said frame for movement between said first and said second chime means so as to strike said first chime means in a first direction of movement and said second chime means in a second direction of movement;

a solenoid coil mounted to said frame and associated with said armature of said striker means and arranged to act thereon to cause said movement in at least one said direction of movement;

resilient means arranged to act on said striker means to urge said striker means at least to an equilibrium position between said first and said second chime means and out of contact therewith; and current control means adapted to power said solenoid coil sufficiently to cause said striker means to strike one of said first and said second chime means and to control the reduction of power, whereby by application of power to said solenoid coil, said striker means is caused to strike one of said first and said second chime means, said solenoid coil is controlled to be maintained for 40 to 60 ms and by an optional gradual reduction of power said striker means returns toward said equilibrium position under influence of said resilient means with insufficient momentum to strike the other of said first and said second chime means.

10. The multi-tone sounder as claimed in claim 9, wherein at steady full power and at zero power said first and said second chime means are out of contact with said striker means.

11. The multi-tone sounder as claimed in claim 9, wherein said control means to the final supply of power in a repetition is reduced suddenly thereby enabling the other of said first and said second chime means to be struck.

12. The multi-tone sounder as claimed in claim 9, further including a sounder operating means remote from said multi-tone sounder arranged to pass a signal to said current control means.

13. The multi-tone sounder as claimed in claim 12, further including a plurality of sounder operating means remote from said multi-tone sounder, each said sounder operating means instructing said current control means to operate said striker means in a predetermined sequence of strikes on said first and said second chime means.

14. The multi-tone sounder as claimed in claim 9, wherein power is suddenly applied to said solenoid coil, power is maintained for a short period and power is then gradually reduced to zero.

15. The multi-tone sounder as claimed in claim 9, wherein power is gradually increased to said solenoid coil, power is maintained for a short period and power is then suddenly reduced to zero.

16. The multi-tone sounder as claimed in claim 9, wherein power is applied to said solenoid coil multiple times in one or more of multiple ways from a selection of ways including (a) suddenly applying power to said solenoid coil and gradually reducing the power to said solenoid coil, (b) suddenly applying power to said solenoid coil and suddenly reducing the power to zero, and (c) gradually increasing the power and suddenly reducing the power to zero.

17. A multi-tone sounder, comprising in combination:

a frame to which are mounted in spaced apart relationship at least a first and a second chime means, each chime means being tuned to a different tone from the other;

striker means including an armature mounted to said frame for movement between said first and said second chime means so as to strike said first chime means in a first direction of movement and said second chime means in a second direction of movement;

a solenoid coil mounted to said frame and associated with said armature of said striker means and arranged to act thereon to cause said movement in at least one said direction of movement;

resilient means arranged to act on said striker means to urge said striker means at least to an equilibrium position between said first and said second chime means and out of contact therewith; and current control means adapted to power said solenoid coil sufficiently to cause said striker means to strike one of said first and said second chime means and to control the reduction of power, whereby by application of power to said solenoid coil, said striker means is caused to strike one of said first and said second chime means and by an optional gradual reduction of power said striker means returns toward said equilibrium position under influence of said resilient means with insufficient momentum to strike the other of said first and said second chime means wherein said control means is arranged to repeat the supply of power to said solenoid coil at intervals of between 200 and 400 ms and preferably about 300 ms.

18. The multi-tone sounder as claimed in claim 17, wherein at steady full power and at zero power said first and said second chime means are out of contact with said striker means.

19. The multi-tone sounder as claimed in claim 17, wherein said control means to the final supply of power in a repetition is reduced suddenly thereby enabling the other of said first and said second chime means to be struck.

20. The multi-tone sounder as claimed in claim 17, further including a sounder operating means remote from said multi-tone sounder arranged to pass a signal to said current control means.

21. The multi-tone sounder as claimed in claim 20, further including a plurality of sounder operating means remote from said multi-tone sounder, each said sounder operating means instructing said current control means to operate said striker means in a predetermined sequence of strikes on said first and said second chime means.

22. The multi-tone sounder as claimed in claim 17, wherein power is suddenly applied to said solenoid coil, power is maintained for a short period and power is then gradually reduced to zero.

23. The multi-tone sounder as claimed in claim 17, wherein power is gradually increased to said solenoid coil, power is maintained for a short period and power is then suddenly reduced to zero.

24. The multi-tone sounder as claimed in claim 17, wherein power is applied to said solenoid coil multiple times in one or more of multiple ways from a selection of ways including (a) suddenly applying power to said solenoid coil and gradually reducing the power to said solenoid coil, (b) suddenly applying power to said solenoid coil and suddenly reducing the power to zero, and (c) gradually increasing the power and suddenly reducing the power to zero.

25. A multi-tone sounder, comprising in combination:

a frame to which are mounted in spaced apart relationship at least a first and a second chime means, each chime means being tuned to a different tone from the other;

striker means including an armature mounted to said frame for movement between said first and said second chime means so as to strike said first chime means in a first direction of movement and said second chime means in a second direction of movement;

a solenoid coil mounted to said frame and associated with said armature of said striker means and arranged to act thereon to cause said movement in at least one said direction of movement;

resilient means arranged to act on said striker means to urge said striker means at least to an equilibrium position between said first and said second chime means and out of contact therewith; and current control means adapted to power said solenoid coil sufficiently to cause said striker means to strike one of said first and said second chime means and to control the reduction of power, whereby by application of power to said solenoid coil, said striker means is caused to strike one of said first and said second chime means and by an optional gradual controlled reduction of power said striker means returns toward said equilibrium position under influence of said resilient means with insufficient momentum to strike the other of said first and said second chime means.

26. The multi-tone sounder as claimed in claim 25, wherein at steady full power and at zero power said first and said second chime means are out of contact with said striker means.

27. The multi-tone sounder as claimed in claim 25, wherein said control means to the final supply of power in a repetition is reduced suddenly thereby enabling the other of said first and said second chime means to be struck.

28. The multi-tone sounder as claimed in claim 25, further including a sounder operating means remote from said multi-tone sounder arranged to pass a signal to said current control means.

29. The multi-tone sounder as claimed in claim 28, further including a plurality of sounder operating means remote from said multi-tone sounder, each said sounder operating means instructing said current control means to operate said striker means in a predetermined sequence of strikes on said first and said second chime means.

30. The multi-tone sounder as claimed in claim 25, wherein power is suddenly applied to said solenoid coil, power is maintained for a short period and power is then gradually reduced to zero.

31. The multi-tone sounder as claimed in claim 25, wherein power is gradually increased to said solenoid coil, power is maintained for a short period and power is then suddenly reduced to zero.

32. The multi-tone sounder as claimed in claim 25, wherein power is applied to said solenoid coil multiple times in one or more of multiple ways from a selection of ways including (a) suddenly applying power to said solenoid coil and gradually reducing the power to said solenoid coil, (b) suddenly applying power to said solenoid coil and suddenly reducing the power to zero, and (c) gradually increasing the power and suddenly reducing the power to zero.

* * * * *